US006145927A

United States Patent [19]

Lo

[11] Patent Number: 6,145,927

[45] Date of Patent: Nov. 14, 2000

[54] STRUCTURE OF A SAFETY BABY SEAT

[76] Inventor: Feng-jung Lo, P.O. Box 82-144, Taipei, Taiwan

[21] Appl. No.: 09/435,690

[22] Filed: Nov. 8, 1999

[51] Int. Cl.[7] ..... A47C 1/08

[52] U.S. Cl. ..... 297/250.1; 297/183.3

[58] Field of Search ..... 297/183.4, 183.3, 297/183.2, 250.1

[56] References Cited

U.S. PATENT DOCUMENTS

| | | | |
|---|---|---|---|
| 4,634,177 | 1/1987 | Meeker | 297/250.1 X |
| 4,688,850 | 8/1987 | Brownlie et al. | 297/183.2 X |
| 5,011,221 | 4/1991 | Wise | 297/183.3 X |
| 5,522,639 | 6/1996 | Jaime | 297/183.3 X |
| 5,961,180 | 10/1999 | Greger et al. | 297/183.4 |
| 5,971,476 | 10/1999 | Gibson et al. | 297/183.4 X |

*Primary Examiner*—Peter M. Cuomo
*Assistant Examiner*—Stephen Vu
*Attorney, Agent, or Firm*—A & J

[57] ABSTRACT

A seat for babies includes an open top container having two opposite side walls, two outer circular members provided on outer surface of the two side walls, two inner circular members provided on outer surface of the two side walls and concentric with the two outer circular members, each of the inner circular members being formed with a plurality of notches and a stud at a center thereof, a handle having two circular lower ends each formed with a center hole, an opening on a circumference thereof, an upper baffle aligned with an upper edge of the opening, a lower baffle aligned with a lower edge of the opening, a pin between the upper and lower baffles, and a chamber above the center hole, two control buttons each having an end fitted in the opening and formed with an inclined surface, two springs each fitted in the chamber, two slides each having an end fitted in the chamber and formed with a recess receiving an upper end of a respective one of the springs, another end of each of the slides having an inclined surface in contact with the inclined surface of a respective on of the control buttons, and two bolts each extending through the center hole into a respective one of the studs.

1 Claim, 6 Drawing Sheets

STRUCTURE OF A SAFETY BABY SEAT

BACKGROUND OF THE INVENTION

1. Field of the Invention

This invention is related to an improvement in the structure of a safety baby seat, and in particular to one which features safety and comfort for the baby.

2. Description of the Prior Art

It has been found that babies should be harnessed in an infant seat or carrier when travelling in a car to provide a degree of protection during an emergency stop or an accident. In fact, many legal jurisdictions now legally require that the baby be harnessed in an appropriate carrier when in a car. President in the market, seats to transport babies in cars are available. The seats offer added comfort and some safety. However, there is an inherent inconvenience with these seats due to their fixed T-shaped handle and their occupying a large amount of space in the car thereby causing difficulties in installing and removing the seat when there is no need for its use. In addition, the seats currently in the market are heavy and large and cannot be used as a cradle. Furthermore, such seats cannot be firmly mounted on the car thereby often causing injuries to the baby in accidents.

Therefore, it is an object of the present invention to provide an improved baby seat which is safe in use and occupies less space and has the advantage of being practical. The improved seat features safety and comfort for the baby in the car.

SUMMARY OF THE INVENTION

This invention is related to an improvement in the structure of a seat for babies.

According to a preferred embodiment of the present invention, a baby seat includes an open top container having two opposite side walls, two outer circular members provided on outer surface of the two side walls, two inner circular members provided on outer surface of the two side walls and concentric with the two outer circular members, each of the inner circular members being formed with a plurality of notches and a stud at a center thereof, a handle having two circular lower ends each formed with a center hole, an opening on a circumference thereof, an upper baffle aligned with an upper edge of the opening, a lower baffle aligned with a lower edge of the opening, a pin between the upper and lower baffles, and a chamber above the center hole, two control buttons each having an end fitted in the opening and formed with an inclined surface, two springs each fitted in the chamber, two slides each having an end fitted in the chamber and formed with a recess receiving an upper end of a respective one of the springs, another end of each of the slides having an inclined surface in contact with the inclined surface of a respective on of the control buttons, and two bolts each extending through the center hole into a respective one of the studs.

It is the primary object of the present invention to provide an improved baby seat which has an easily adjustable handle.

It is another object of the present invention to provide an improved baby seat which can be firmly mounted on the seat of a car.

It is still another object of the present invention to provide an improved baby seat which is safe in use.

It is still another object of the present invention to provide an improved baby seat which is compact in size and convenient to carry.

It is a further object of the present invention to provide an improved baby seat which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
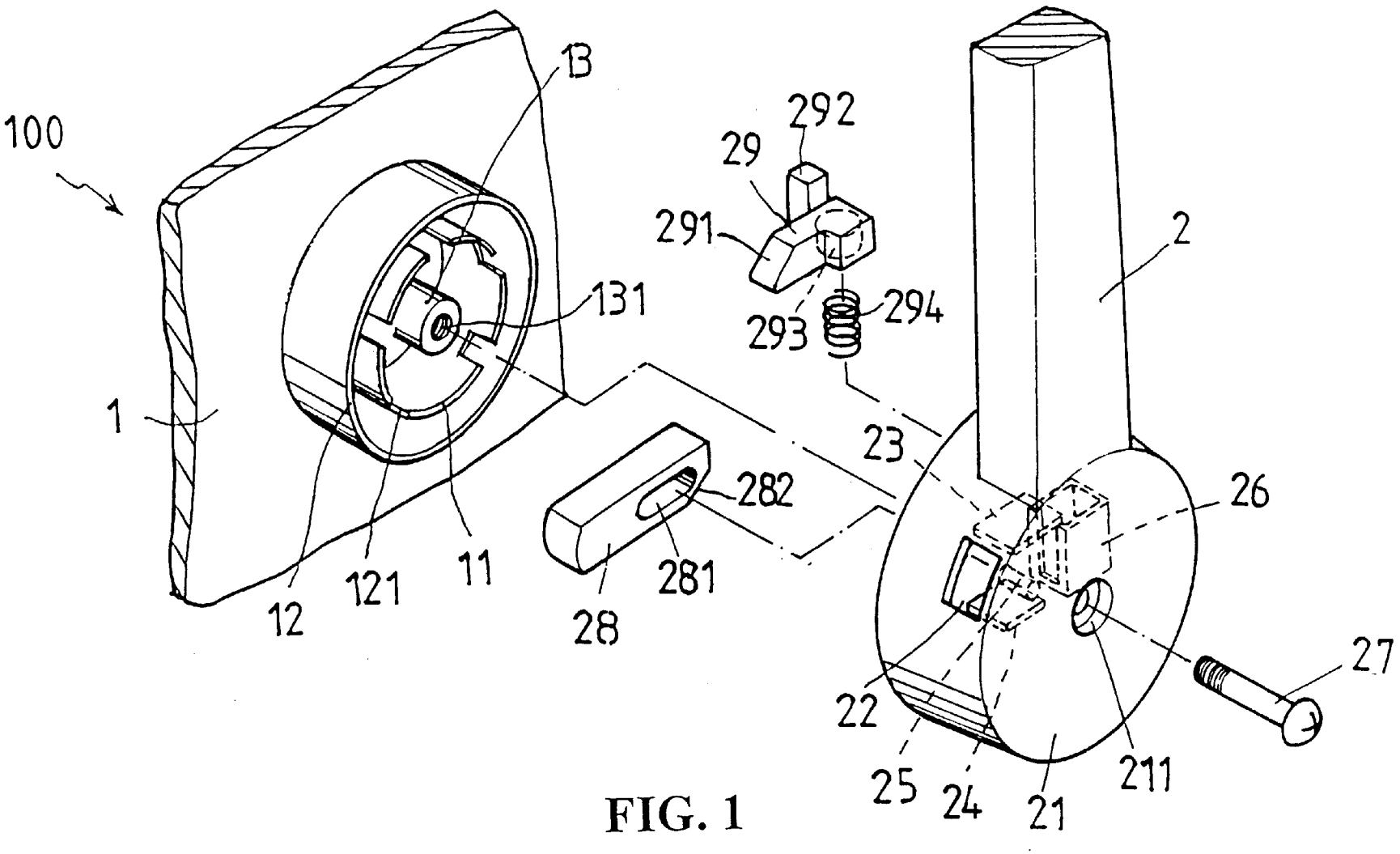
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
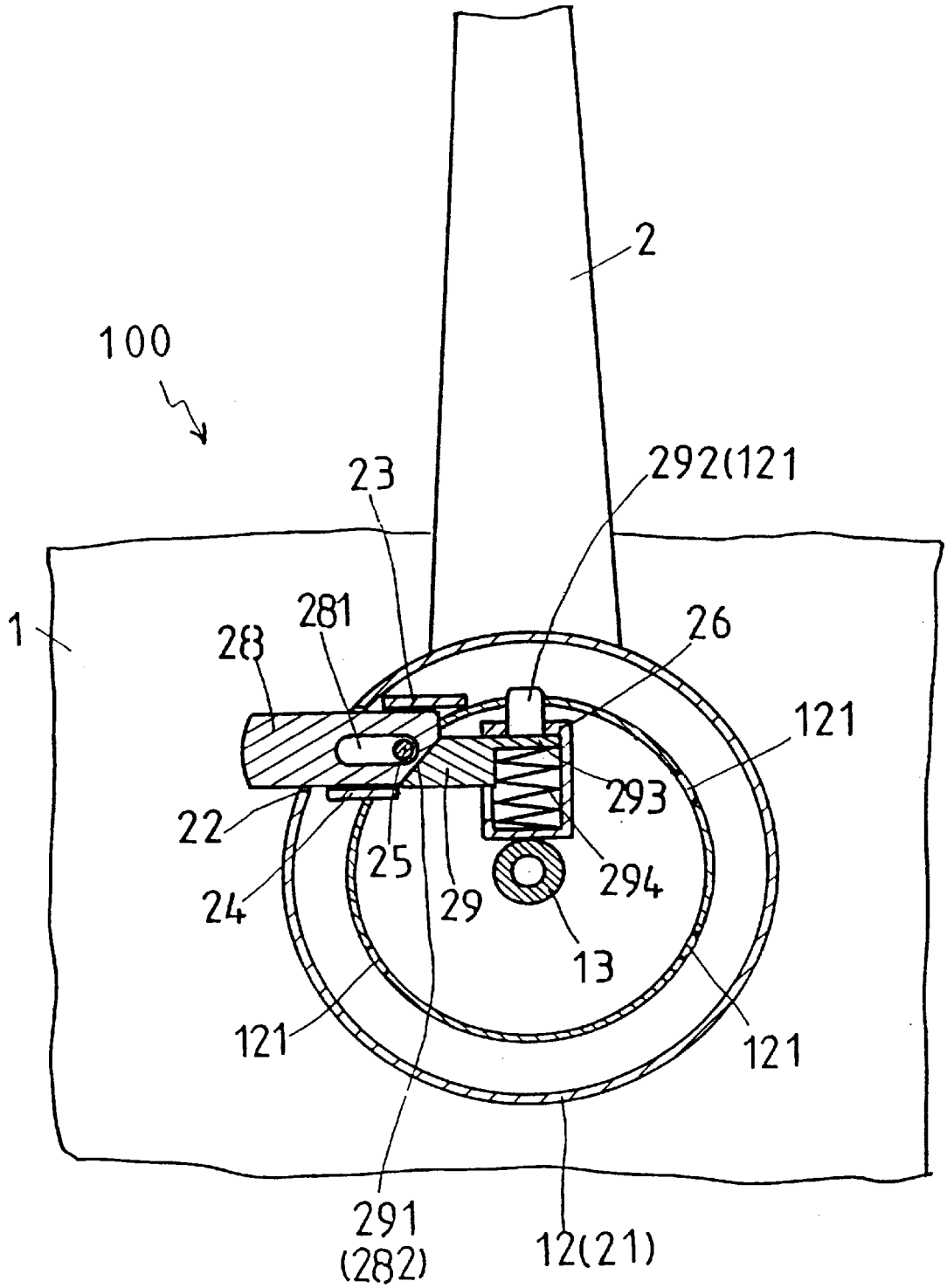
FIG. 2 is a sectional view of the present invention.
Figure 3:
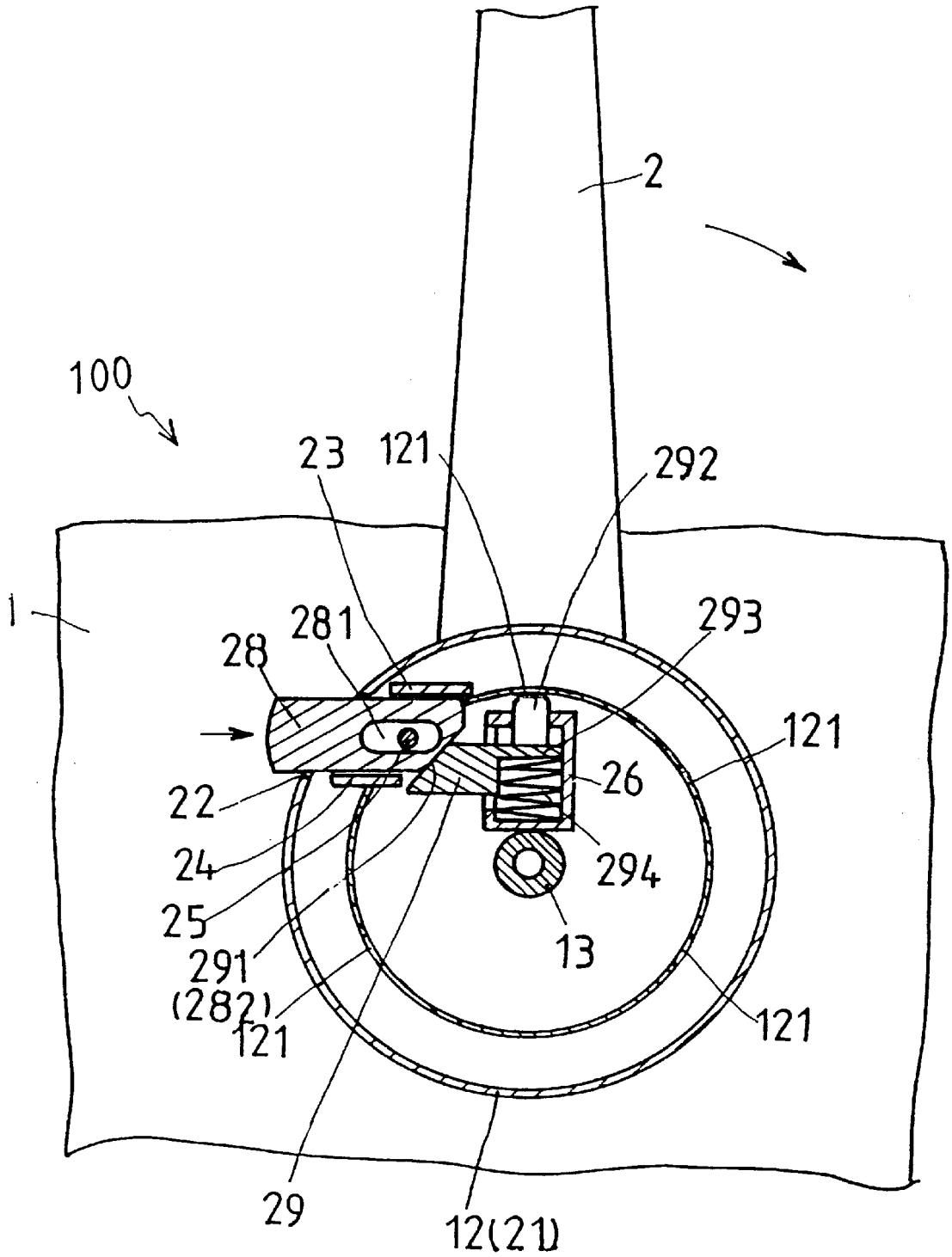
FIGS. 3 and 4 illustrate how to adjust the angular position of the handle of the present invention.
Figure 4:
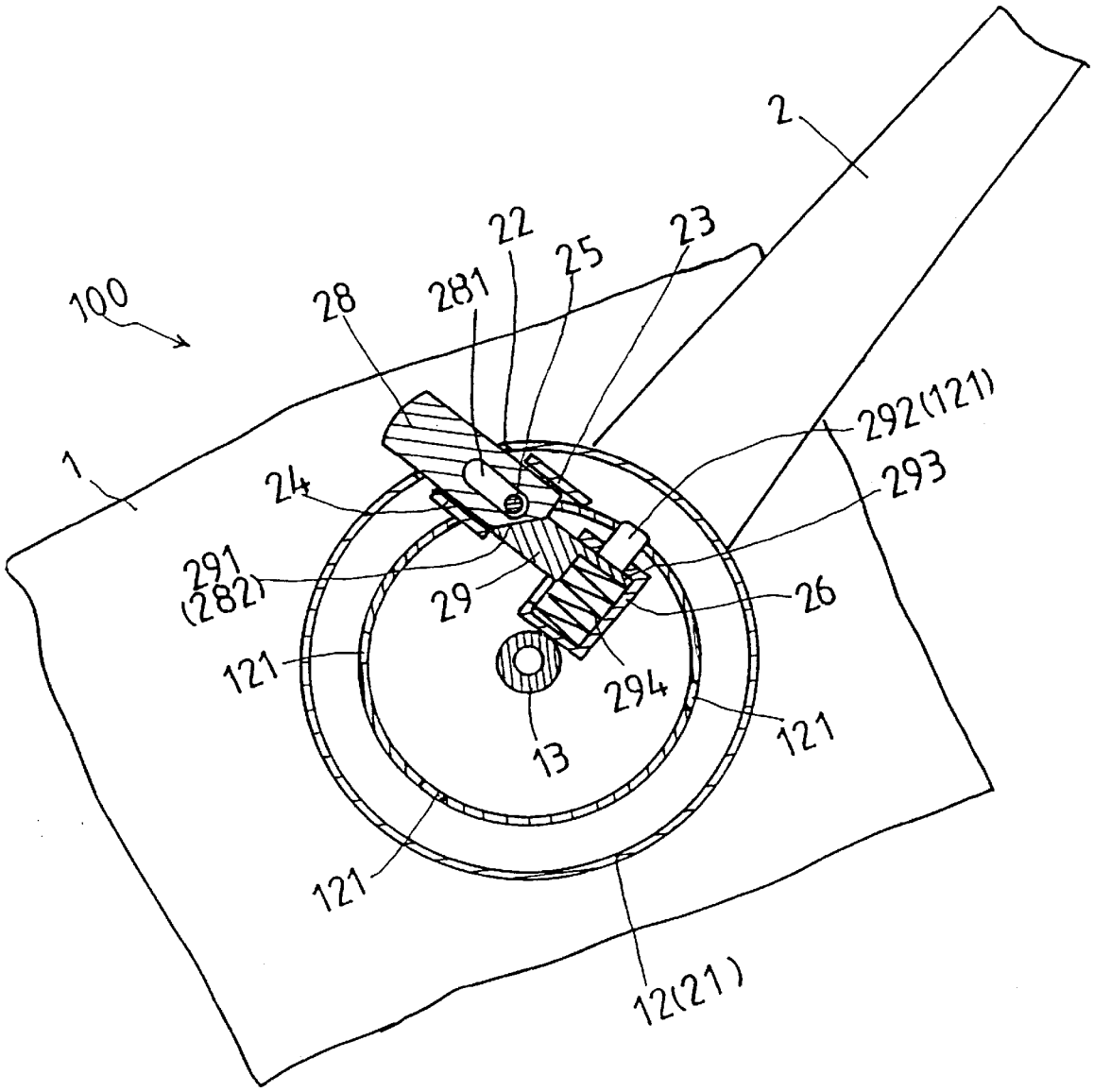
Figure 6:
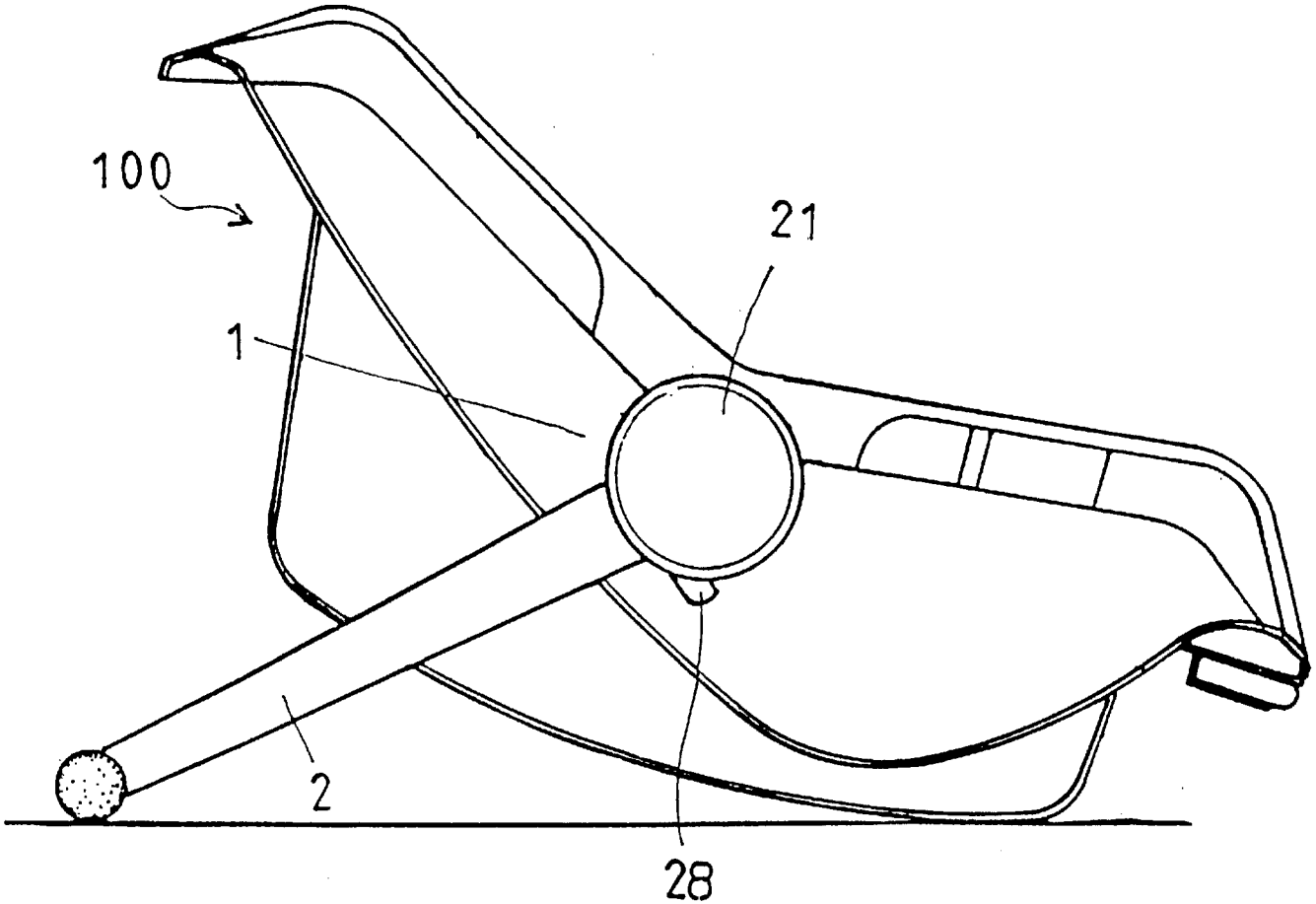
FIG. 6 is a side view of the present invention placed on the floor.

With reference to the drawings and in particular to FIGS. 1, 2 and 6 thereof, the safety seat 100 for babies according to the present invention generally comprises an open top container (shown but not numbered), a handle 2, two control buttons 28, two slides 29, two springs 294 and two bolts 27. The safety seat 100 has two opposite side walls 1 each formed with an outer circular member 12 and an inner circular member 11 concentric with the outer circular member 12. The inner circular member 12 is formed with five equidistant notches 12 and a stud 13 at the center thereof The stud 13 has a threaded hole 131 adapted to engage with the bolt 27, so that the bolt 27 can extend through a center hole 211 at the lower circular end 21 of the handle 2 to engage with the threaded hole 131 of the stud 12 thereby connecting the handle 2 to the side wall 1. Each of the lower circular ends 21 of the handle 2 is formed with an opening 22 in which is fitted the control button 28. The interior of the lower circular end 21 of the handle 2 has an upper baffle 23 aligned with the upper edge of the opening 22, a lower baffle 24 aligned with the lower edge of the opening 22, and a pin 25 between the upper and lower baffles 23 and 24. The control button 28 is formed with an inclined surface 282 at an end thereof and a slot 281 close to the inclined side 291. The control button 28 is fitted in the opening 22 with its slot 281 receiving the pin 25. The interior of the lower circular end 21 of the handle 2 is further provided with a chamber 26 right above the center of the lower circular end 21, in which is fitted the spring 294. The slide 29 has an end fitted in the chamber 26 and formed with a recess 293 receiving the upper end of the spring 294. The other end of the slide 29 has an inclined surface 291 in contact with the inclined surface 282 of the control button 28. The slide 29 is provided with a protuberance 292 configured to engage with the notch 121 of the inner circular member 11 so as to keep the handle 2 at a fixed position. Referring to FIGS. 3 and 4, when desired to adjust the angular position of the handle 2, it is only necessary to depress the control button 28 thereby forcing the slide 29 to go downwardly and therefore disengaging the protuberance 292 of the slide 29 from the notch 121 of the inner circular member 11 (see FIG. 3). In the meantime, the handle 2 can be freely rotated with respect to the side wall 1. As the protuberance 292 is aligned with a notch 121 of the inner circular member 11, the spring 294 will push the slide 29 upwardly thus engaging the protuberance 292 with the notch 121 and therefore keeping the handle 2 at a fixed position. Accordingly, the handle 2 can be easily adjusted in position as desired.

Figure 5:
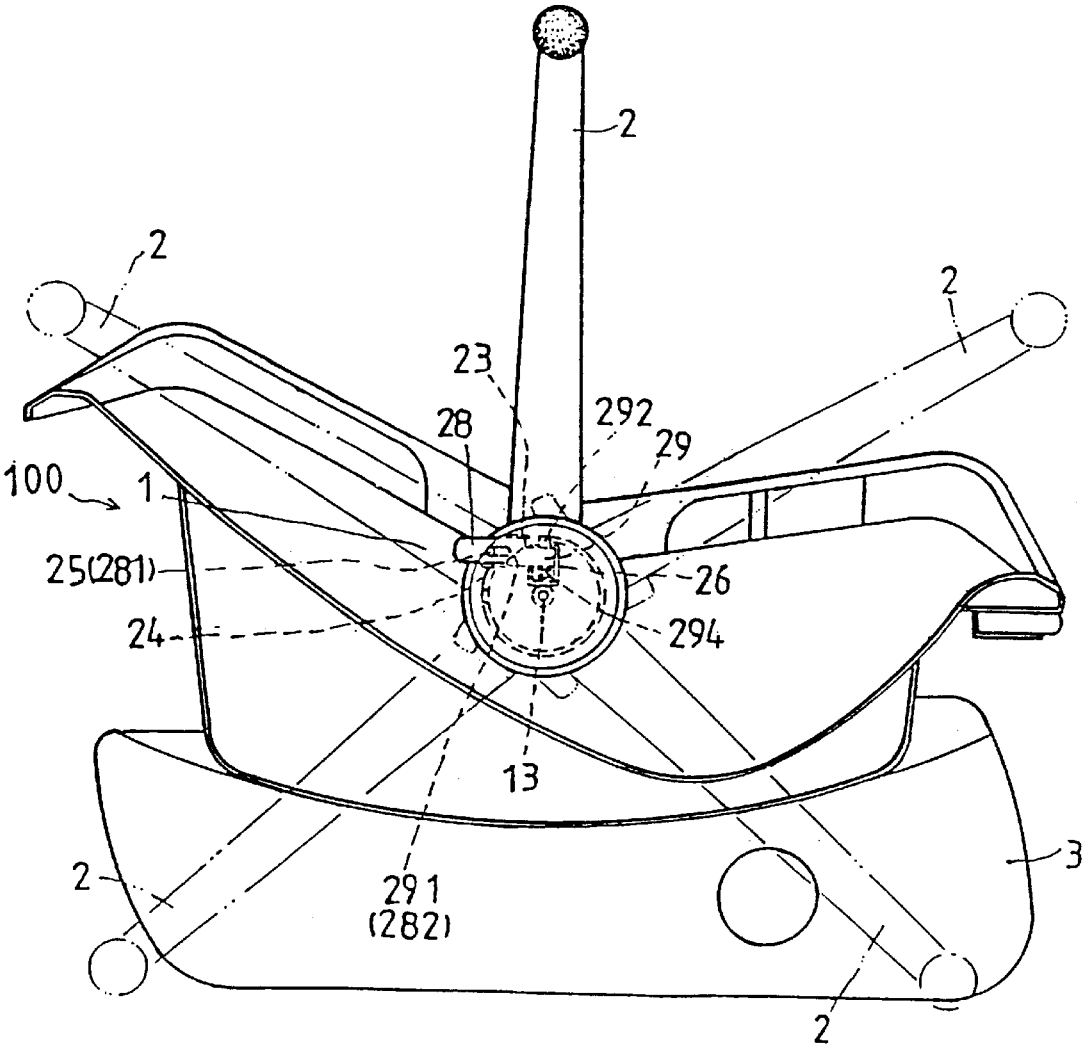
FIG. 5 illustrates how to mount the present invention on the seat of a car.

FIG. 5 illustrates how to mount the seat 100 according to the present invention on a seat 3 of a car. As shown, the handle 2 is rotated downwardly to engage with the bottom of the seat 3 thereby keeping the seat 100 firmly on the seat 3 of the car. FIG. 6 illustrates how to use the present invention as a cradle on the floor.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A seat for babies comprising:

an open top container having two opposite side walls;

two outer circular members provided on an outer surface of said two side walls;

two inner circular members provided on the outer surface of said two side walls and concentric with said two outer circular members, each of said inner circular members being formed with a plurality of equidistant notches and a stud at a center thereof, said stud having a threaded hole;

a handle having two circular lower ends each formed with a center hole, an opening on a circumference thereof, an upper baffle aligned with an upper edge of said opening, a lower baffle aligned with a lower edge of said opening, a pin between said upper and lower baffles, and a chamber above said center hole;

two control buttons each having an end fitted in said opening and formed with an inclined surface and a slot close to said inclined surface;

two springs each fitted in said chamber;

two slides each having an end fitted in said chamber and formed with a recess receiving an upper end of a respective one of said springs, another end of each of said slides having an inclined surface in contact with said inclined surface of a respective one of said control buttons, each of said slides having a protuberance configured to engage with one of said notches of said inner circular members; and two bolts each extending through said center hole into said threaded hole of a respective one of said studs.

* * * * *